US005470141A

United States Patent [19]

Billingham

[11] Patent Number: 5,470,141

[45] Date of Patent: Nov. 28, 1995

[54] MODULAR FILING SYSTEM

[76] Inventor: Paul R. Billingham, 22 Heathfield Ter., Chiswick, London W4 4JE, England

[21] Appl. No.: 114,984

[22] Filed: Sep. 1, 1993

Related U.S. Application Data

[63] Continuation of Ser. No. 689,749, filed as PCT/GB01402, Nov. 23, 1989, abandoned.

[30] Foreign Application Priority Data

| | | | |
|---|---|---|---|
| Nov. 23, 1988 | [GB] | United Kingdom | 8827291 |
| Nov. 30, 1988 | [GB] | United Kingdom | 8827982 |
| Dec. 21, 1988 | [GB] | United Kingdom | 8829850 |

[51] Int. Cl.[6] ..... A45C 5/00

[52] U.S. Cl. ..... 312/205; 312/248

[58] Field of Search ..... 312/248, 188, 312/183, 205

[56] References Cited

U.S. PATENT DOCUMENTS

| | | | |
|---|---|---|---|
| 1,582,823 | 4/1926 | Jones | 312/248 |
| 1,595,761 | 8/1926 | Doughty . | |
| 2,190,707 | 2/1940 | Feldman . | |
| 4,433,761 | 2/1984 | Winter et al. . | |

FOREIGN PATENT DOCUMENTS

| | | |
|---|---|---|
| 2736725 | 11/1978 | Germany . |
| 0327306 | 3/1958 | Switzerland . |
| 0659112 | 10/1951 | United Kingdom . |

*Primary Examiner*—Kenneth J. Dorner
*Assistant Examiner*—Gerald A. Anderson
*Attorney, Agent, or Firm*—Fay, Sharpe, Beall, Fagan, Minnich & McKee

[57] ABSTRACT

A filing system comprising a box file and a concertina file which is housed in the box file, the box file preferably being split into two parts along a diagonal of the end walls, so that it can be opened out onto a surface and the concertina file can then be extended out of it to allow access to the contents. In alternative forms the end walls are divided along different lines (for example into an L-shape) and the box may be formed from a blank of sheet material such as cardboard, or it may be moulded from a resilient plastics material.

4 Claims, 18 Drawing Sheets

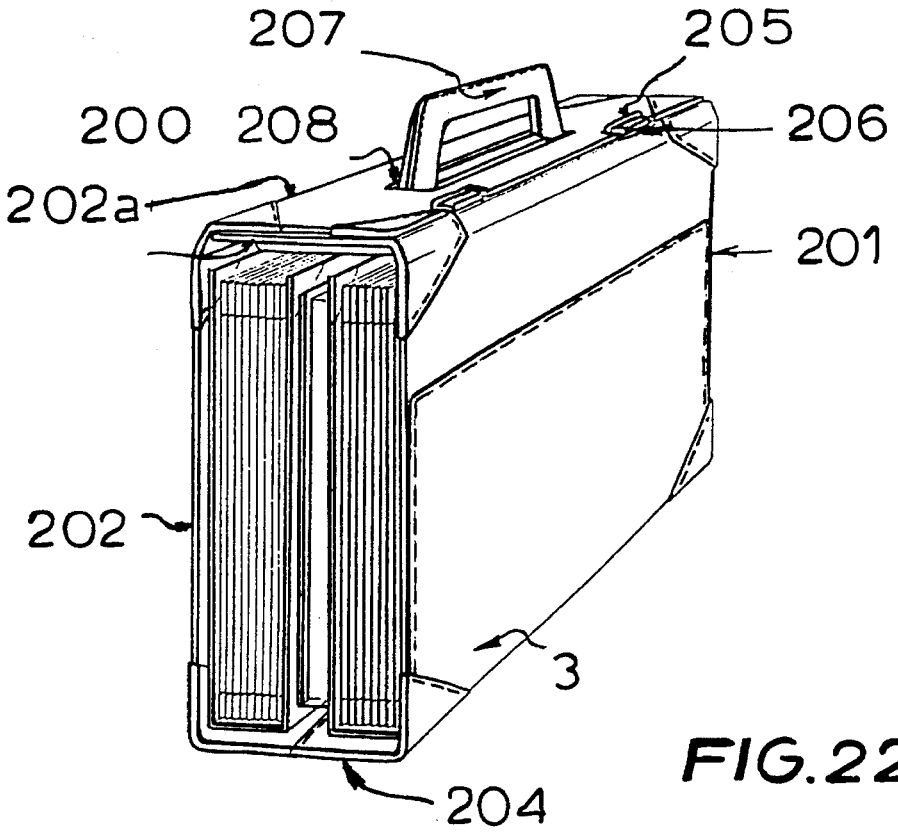
FIG. 22
FIG. 23
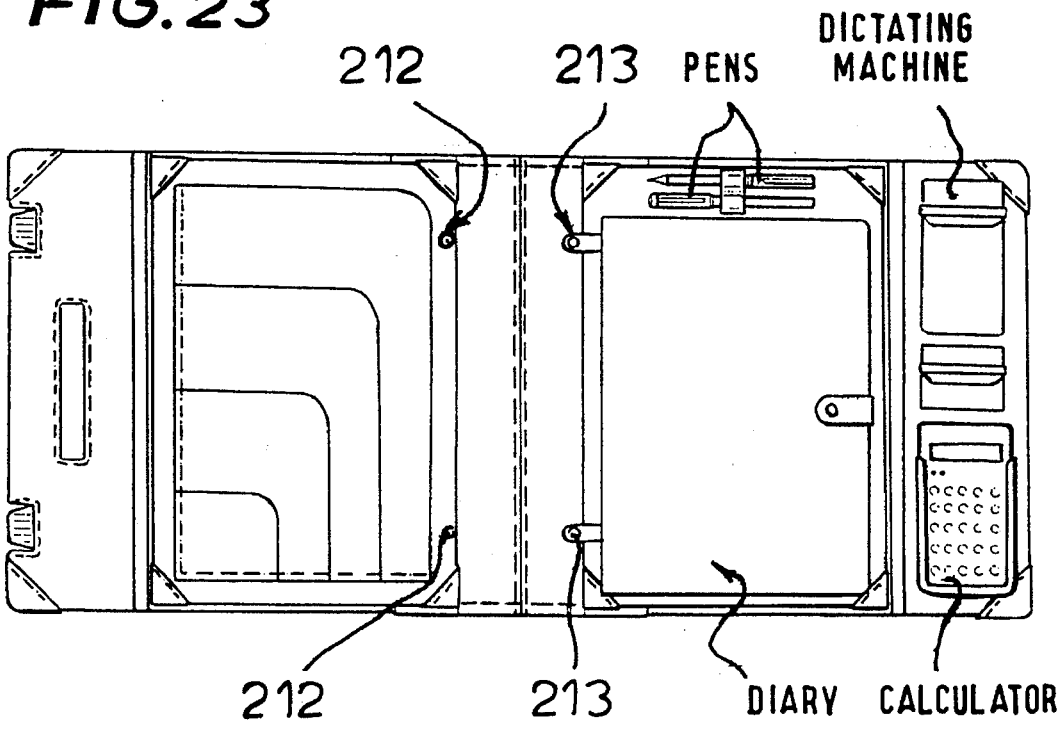

FIG. 28
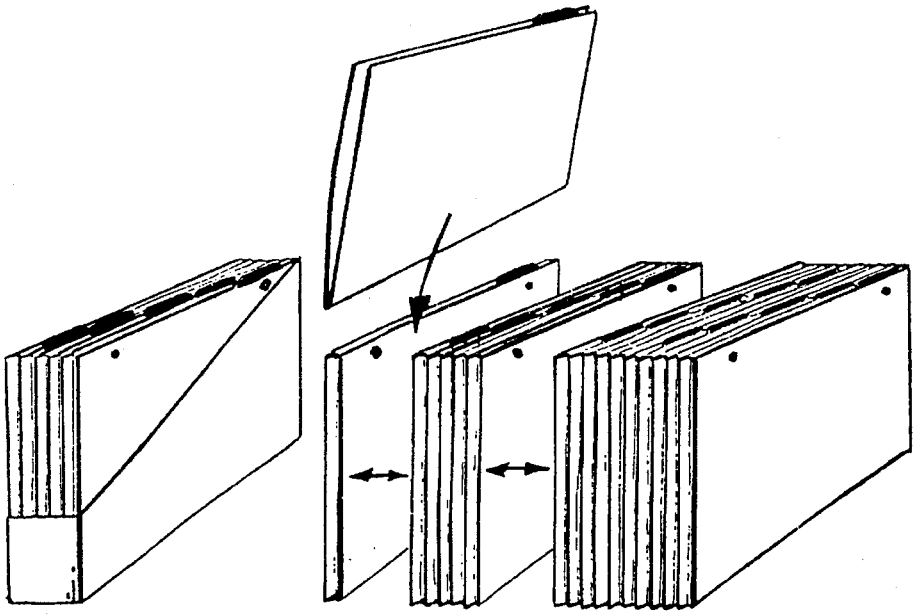
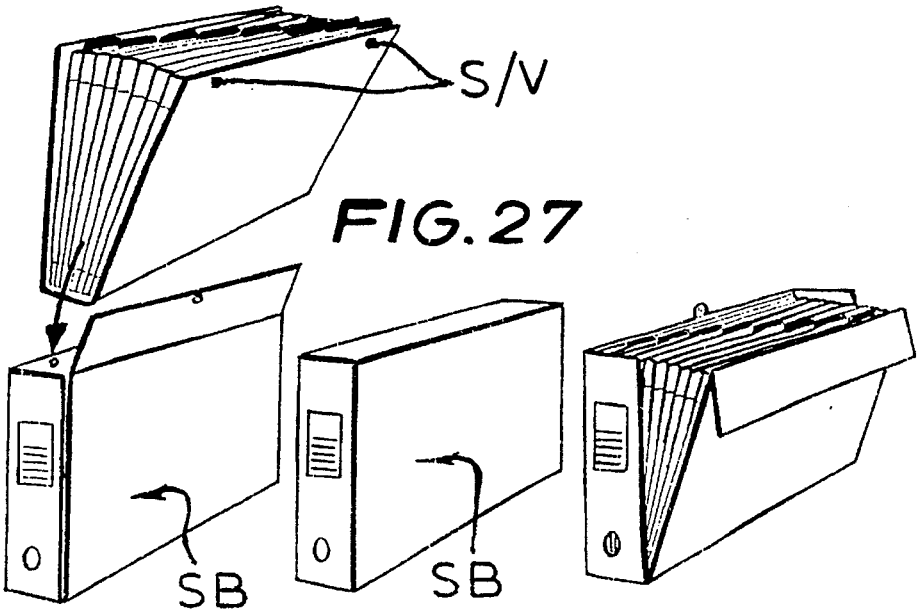
FIG. 27
FIG. 29

MODULAR FILING SYSTEM

This is a continuation of application Ser. No. 07/689,749 filed on filed as PCT/GB89/01402, Nov. 23, 1989, now abandon.

This invention relates to filing systems, and in particular, to filing systems incorporating so-called "concertina" files.

The use of "concertina" files for small scale filing systems is well-known, but such devices are difficult to incorporate in a larger system, and rather cumbersome to store, as a consequence of their lack of rigidity. Accordingly, the present invention seeks to provide a modular filing system which incorporates, or is adapted for use with concertina files and allows tidy storage of the files whilst also providing easy access to their contents.

A first form of the invention therefore provides a box file in two flexibly connected parts, comprising a pair of rectangular wall-members flexibly connected together along a common side edge, each of said wall-members having at least one further wall-member rigidly connected to it at right-angles so as to form a box shape when the two parts are closed together, and adapted to receive a concertina file, one of the wall-members, and a corresponding side of the concertina file, carrying co-operating connection means; the box also having end walls which are diagonally divided from the connected edge to facilitate access when the box is opened.

The invention also extends to a box file according to claim 1 comprising two flexibly connected parts and comprising a pair of rectangular wail-members which are flexibly connected together along a common side edge, and each having a further wall member rigidly connected to its opposite edge at right angles; each part further comprising a pair of opposed end walls which are cut away so as to co-operate with correspondingly cut-away end walls of the other part.

Preferably the internal surface of one of the wall members of one part is provided with connecting means such as an aperture or flap which is adapted to co-operate with a corresponding flap or aperture of the concertina file, so as to retain it in the box.

According to a further aspect of the invention there is provided a closure catch for a box file, adapted to be incorporated on the edges of two walls of the box, which meet at right angles when the box is closed and comprising: a first member comprising at least one projecting tongue and adapted for attachment to one of said walls so as to project from the edge, parallel to the plane of the wall, and a second generally channel shaped member adapted to fit along the edge of the second wall so as to form a detent for the said tongue, the arrangement being such that the walls can be flexed slightly to allow the catch to be engaged and disengaged. Preferably, an aperture or recess to receive the tongue is formed adjacent to the edge of the wall of the second member which carries the channel member, so that the adjacent edge of the channel member forms a reinforcement for the aperture or recess.

In a second form of the invention, there is provided a "box file" of a conventional "book shape", one of whose large sides is arranged to open in a flap-like fashion, the inner surface of the opposite side being provided with extensible securing means which is adapted for attachment to one side of a cooperating concertina file, which can be extended out onto the flap when it is opened.

In this arrangement, the opening side may also be provided with flanged outer edges, as in the first mentioned form of the invention, so that it forms a tray like structure to retain the concertina file as it is extended out of the box.

The cooperating concertina file is constructed with its flat sides slightly smaller than the flap-like lid of the box file, so that it fits inside the box file in its contracted condition.

According to another aspect of the invention, a concertina file is provided with extensible securing means attached to one of its flat sides, and adapted to be secured to the inner surface of a cooperating box file.

The invention also extends to a modular filing unit, comprising a box file, a concertina file of suitable size to fit inside the box file, and securing means adapted to connect the inner surface of one of the large sides of the box file, to a cooperating side of the concertina file, whereby, in use, the box file can be stood on a surface such as a desk, and one side can be opened downwards onto the surface into a position in which it acts as a support for the base of the concertina file, which can then be expanded from the interior of the box file so as to slide along the inner surface of the lid. Preferably, the outer side wall of the concertina file, and one side surface of the box file, carry indexing sheets upon which the nature of the content can be listed, and in addition, indexing tabs may be provided on each of the concertina pockets, for correspondingly identifying descriptions.

A further aspect of the present invention also seeks to provide a relatively easily portable filing system combined with a workstation providing a writing surface.

According to this further aspect of the invention there is provided a portable work station comprising a foldable book-style jacket or casing having a pair of rigid covers connected by a spine, and including internal attachment means for securing a concertina-type pocket file inside the jacket with the base of the file abutting the spine of the jacket, whereby the jacket can be opened out flat onto a work surface such as a table, so that the inner surface of one of the covers forms a horizontal support for carrying a writing pad desk-diary or the like. The facing upstanding surface of the concertina file may also form a vertical support for informational material; and may for this purpose be provided with a transparent pocket to retain a sheet of informational material such as a calendar. The arrangement is thus such that the user can store relevant paper work in an appropriate pocket of the concertina-file, and when correspondence, calculations or the like need to be carried out, he can stand the jacket on a table in front of him on its spine, with one of the covers facing him, and open the jacket so that the inner surface of the facing cover, which preferably carries a writing pad, lies flat on the table in front of him.

The invention also extends to a concertina file adapted to cooperate with the attachment means of the jacket or casing. Preferably the attachment means comprises a gusset or flap in the spine of the cover and the concertina file has a cooperating flap which is inserted into or through it.

Preferably, the covers are provided with closure means comprising an additional flap or fastening device which can extend over the open side of the jacket to hold it closed for example with press-studs, VELCRO (R.T.M.) or similar material.

According to a yet further aspect the present invention provides a transportable work station comprising first and second pivotally interconnected members each having a work surface, the members being pivotable between a closed position where they lie face-to-face, an open, operative position where the work surfaces lie side-by-side, and means for temporarily securing the first and second members to one another in the operative position to provide a unified work surface.

Preferably at least one member has a rigid box like construction which is open along one side so that papers and the like may be stored in the box member.

Preferably the open sided storage box has means for temporarily locating a concertina-type pocket file for papers. The pocket and the base member may include inter-engaging locking means, e.g. press-studs or VELCRO (R.T.M.) strips. The filing pockets may be provided with means for inter-engaging with one another as well as with the storage box. This may be achieved by having "male" and "female" interlocking means on opposite sides of the pockets, and also on the inside of the storage box so that the pockets can inter-engage with either adjacent pocket(s) or the inside of the storage box.

In another aspect the invention provides a filing system comprising a plurality of pockets for receiving paper and the like, and a plurality of storage boxes for receiving one or more of the pockets.

The pockets may be inter-connectable. Also the pockets may be temporarily interlocked or fitted to the storage boxes. The pockets may be of the concertina type, expandable to accommodate paper therein. The storage boxes may be provided with means e.g. a gusset or the like, allowing expansion of the storage box to allow easier access to pockets contained therein.

Some embodiments of the invention will now be described by way of example with reference to the accompanying drawings, in which FIG. 1 is a perspective view from one side of a first type of box file of the present invention;

Figure 8A:
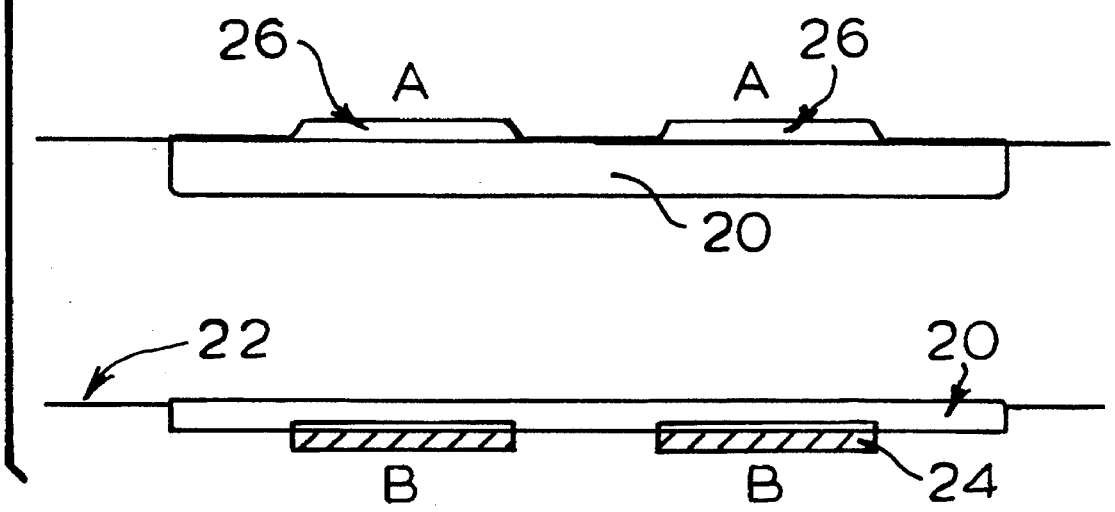
Figure 8B:
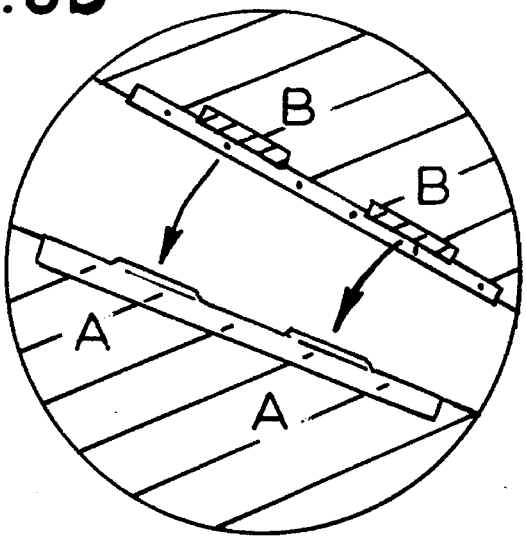
Figures 9, 10, 11:
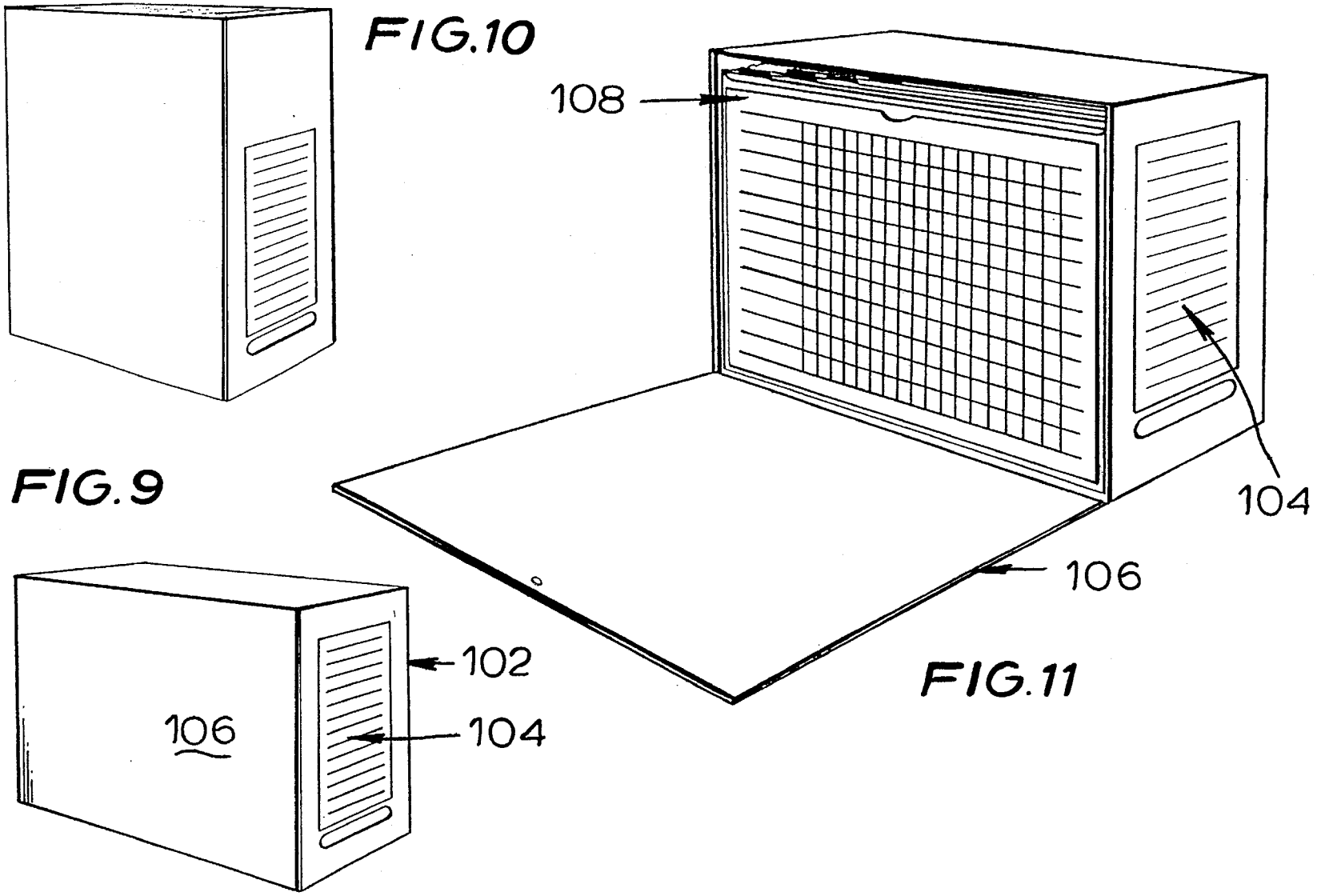
Figure 12:
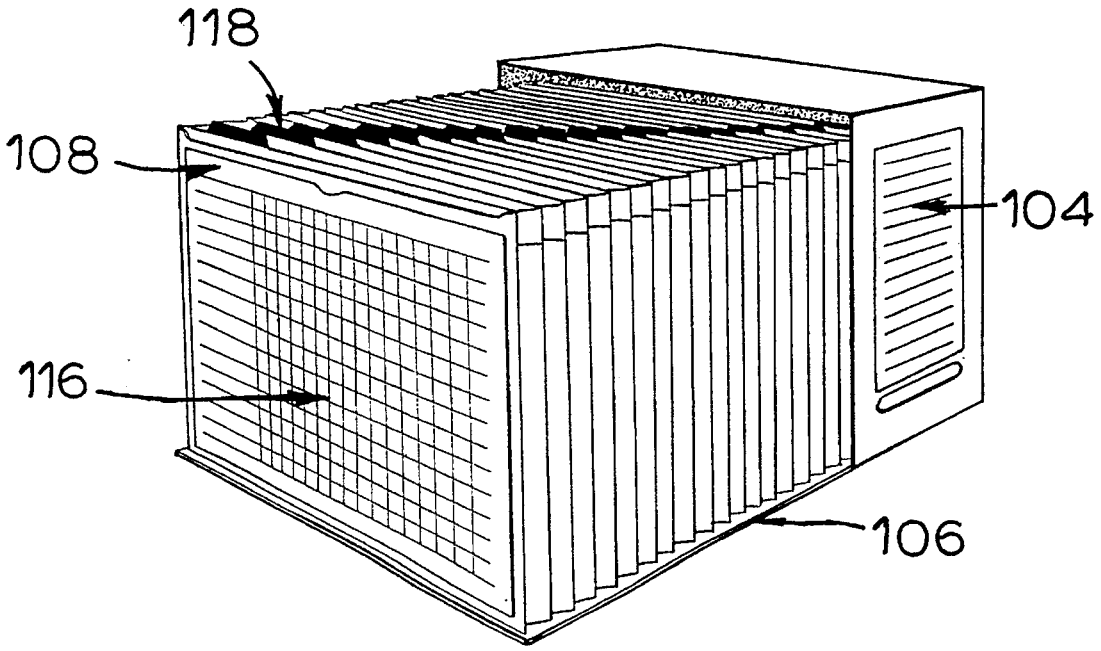
Figure 13:
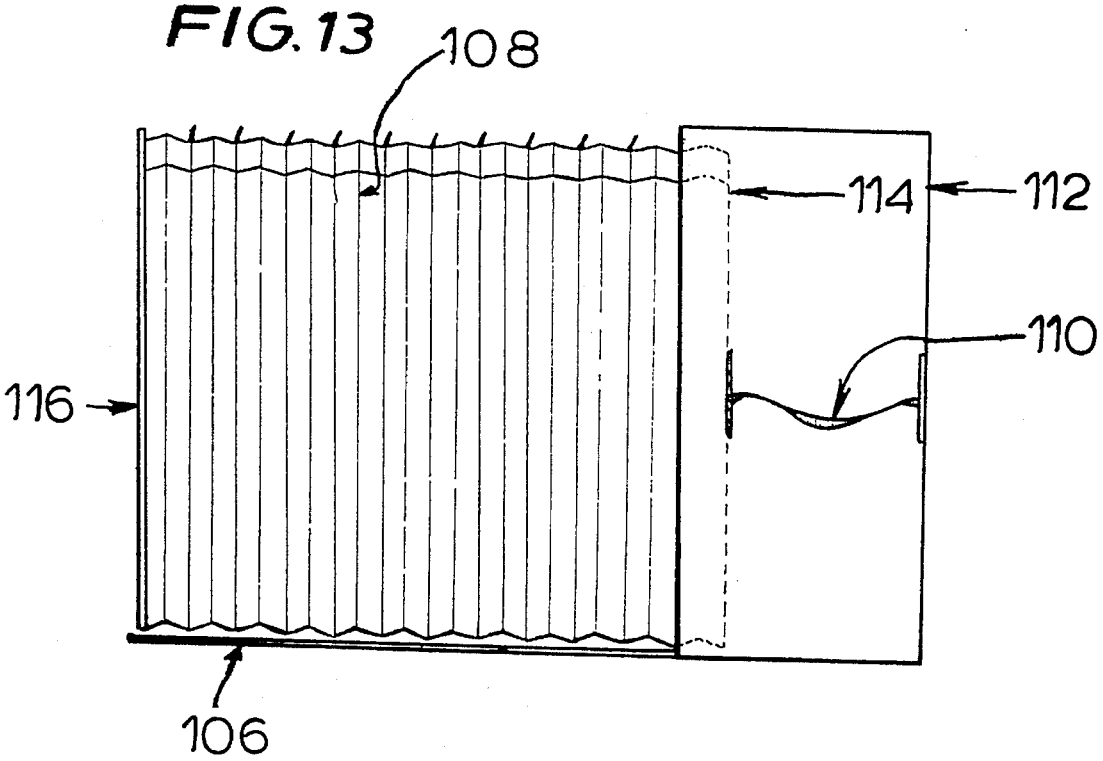
Figure 14:
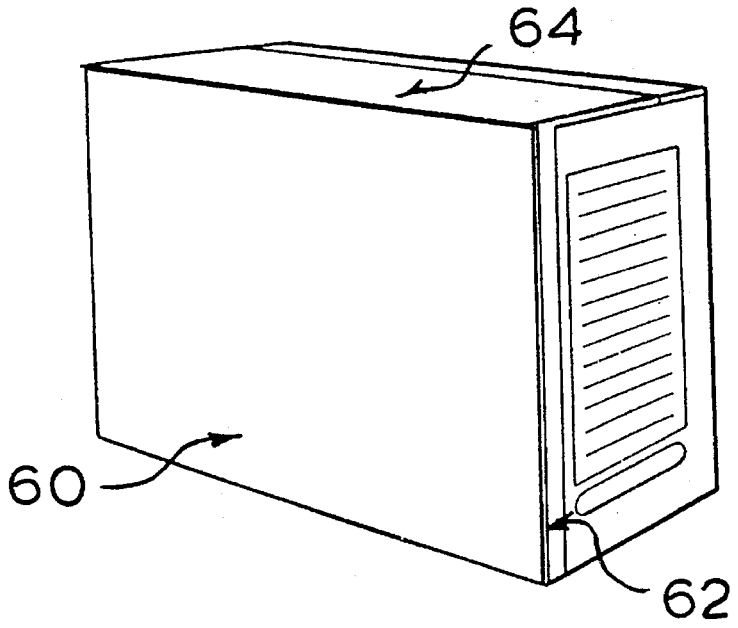
Figure 15:
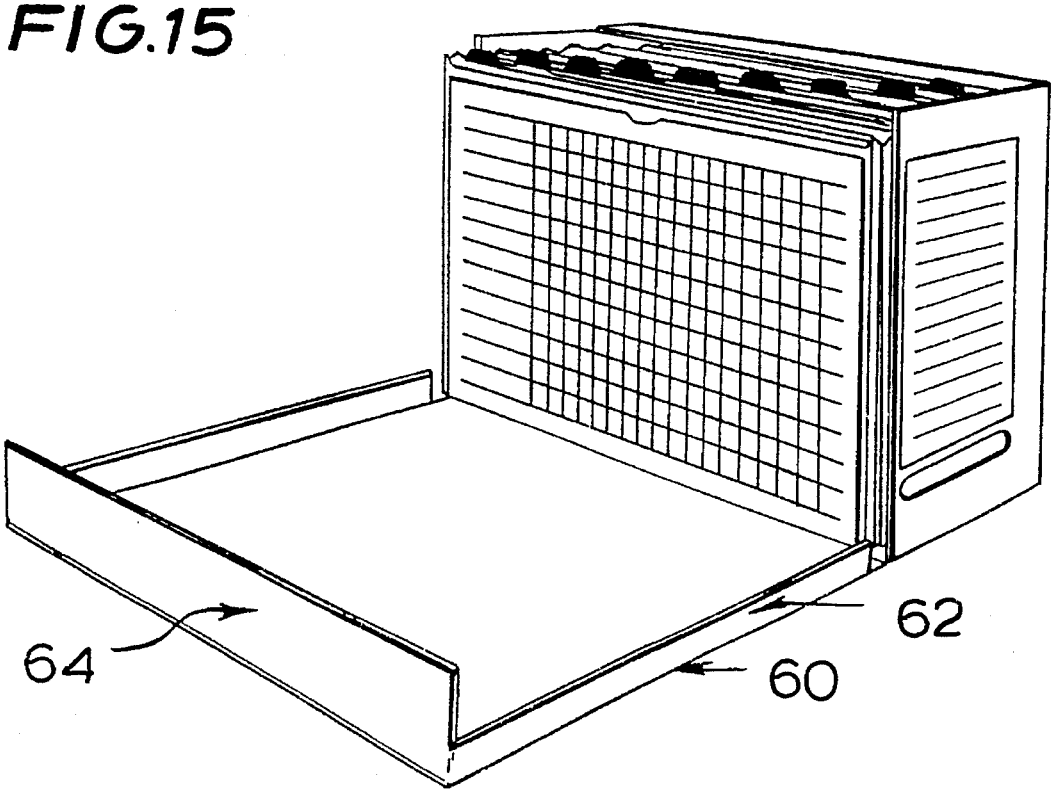
Figure 16:
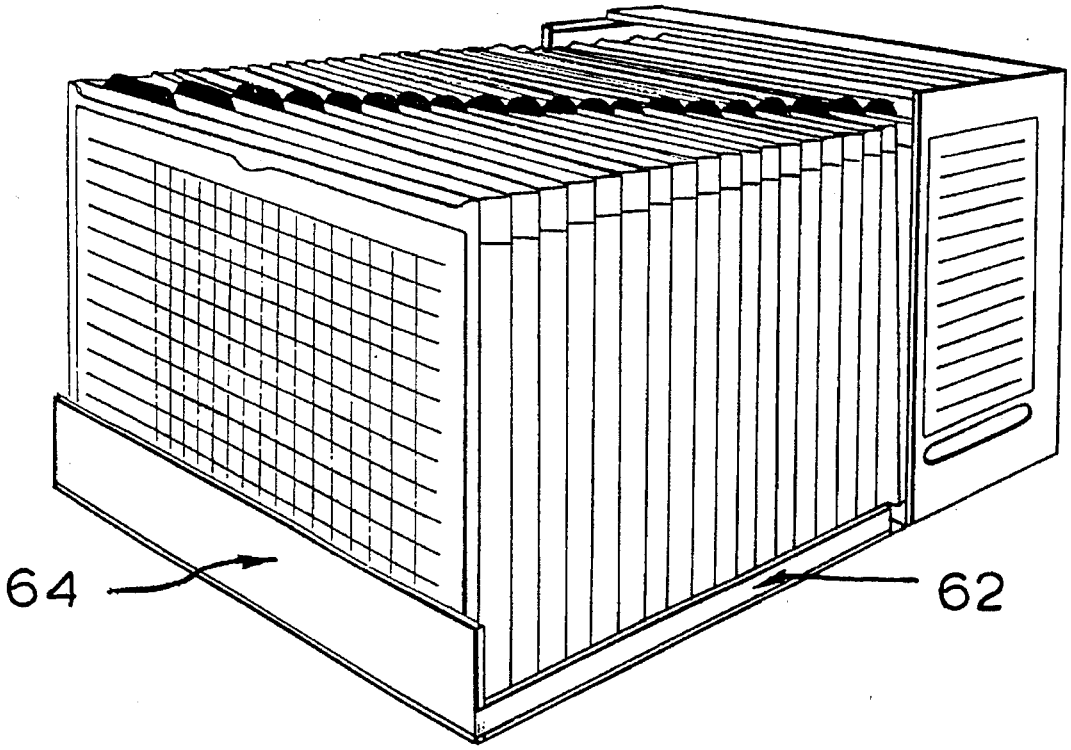
Figure 17:
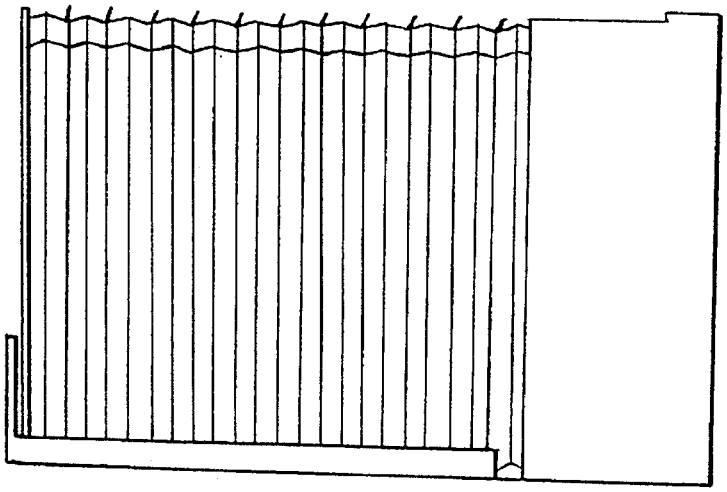
Figure 19:
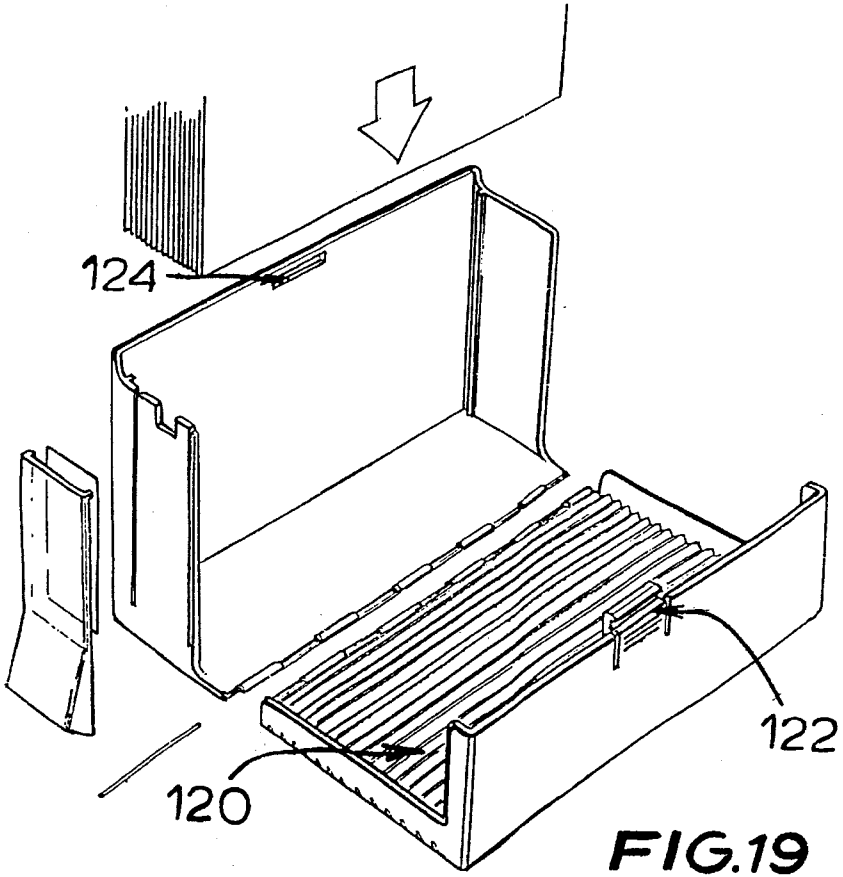
Figure 18:
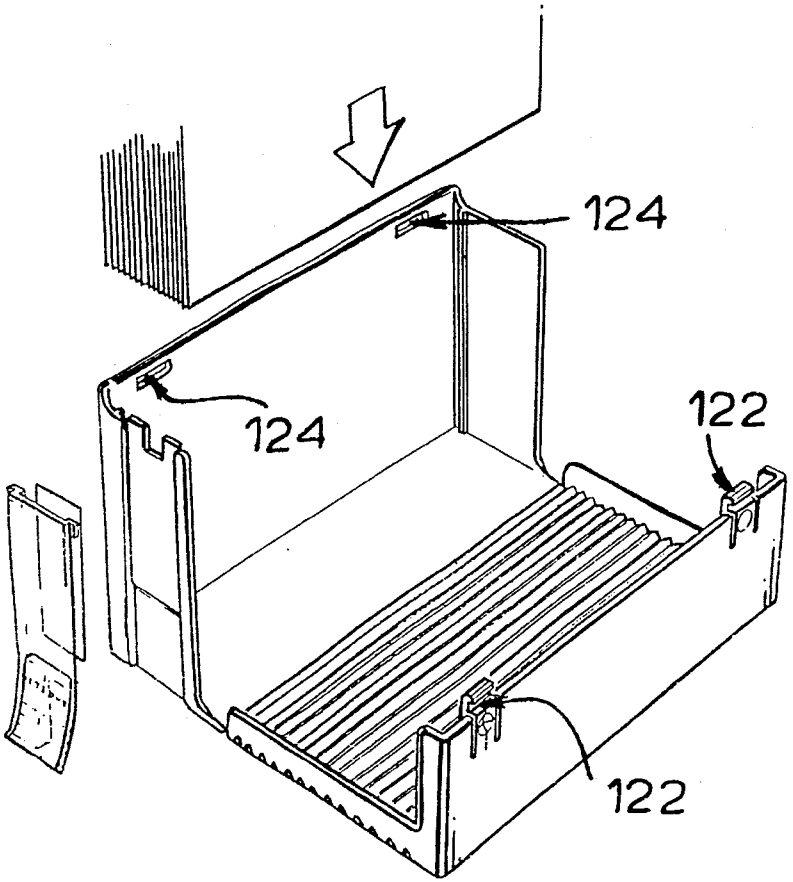
Figure 20:
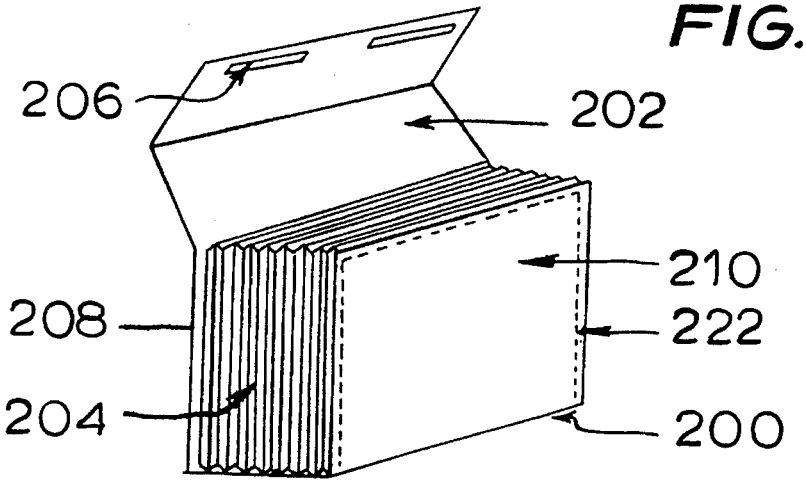
Figure 21:
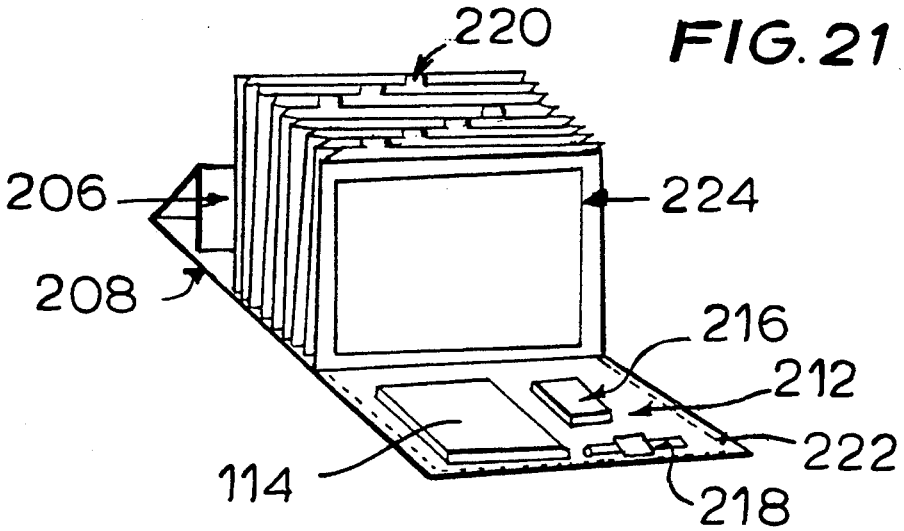
Figure 21A:
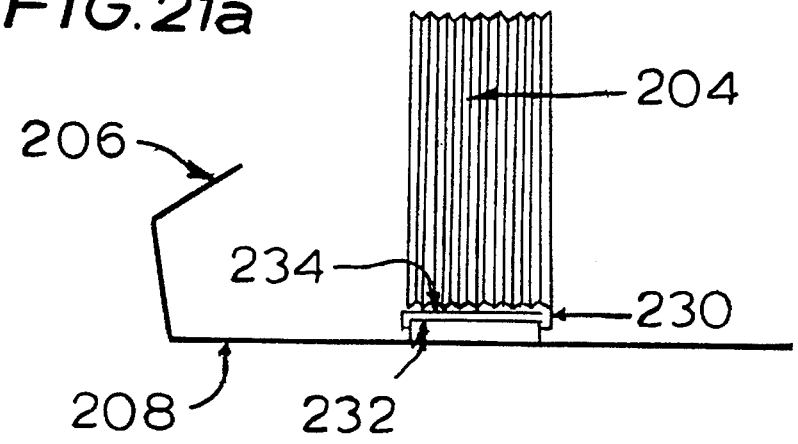
Figure 24:
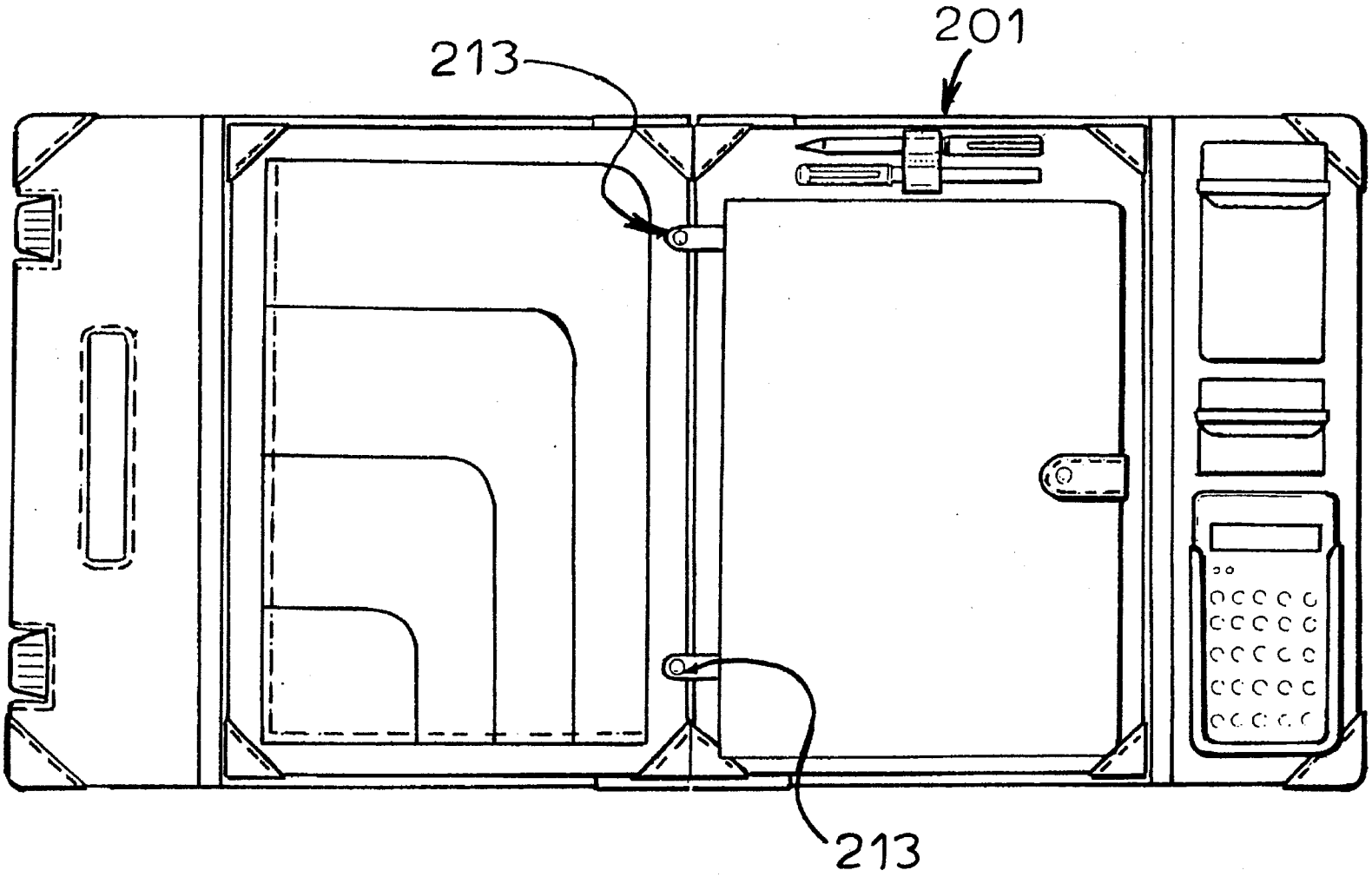
Figure 25:
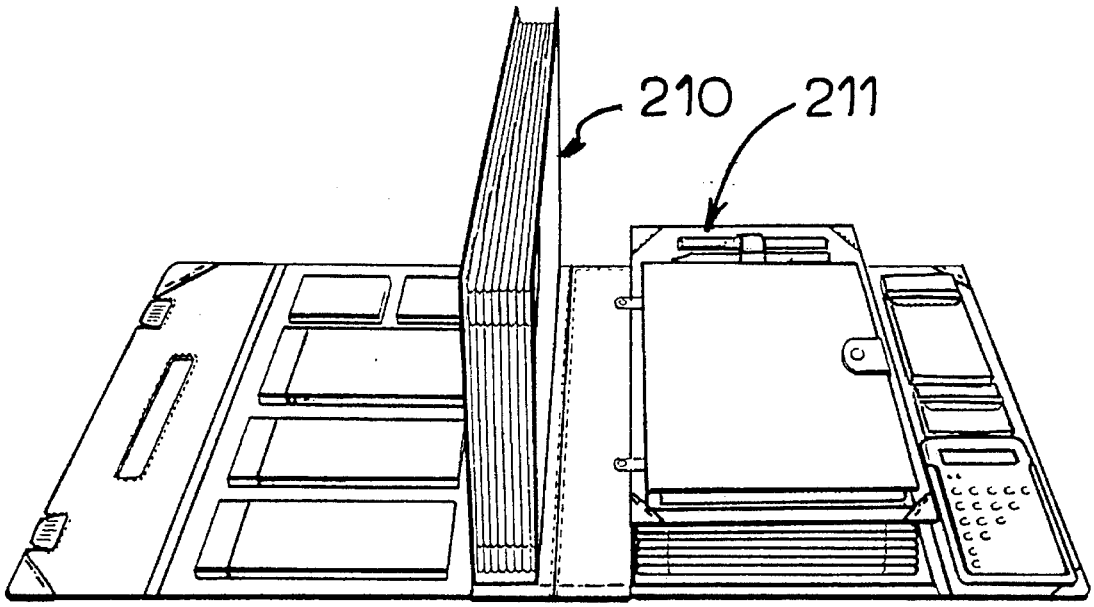
Figure 26:
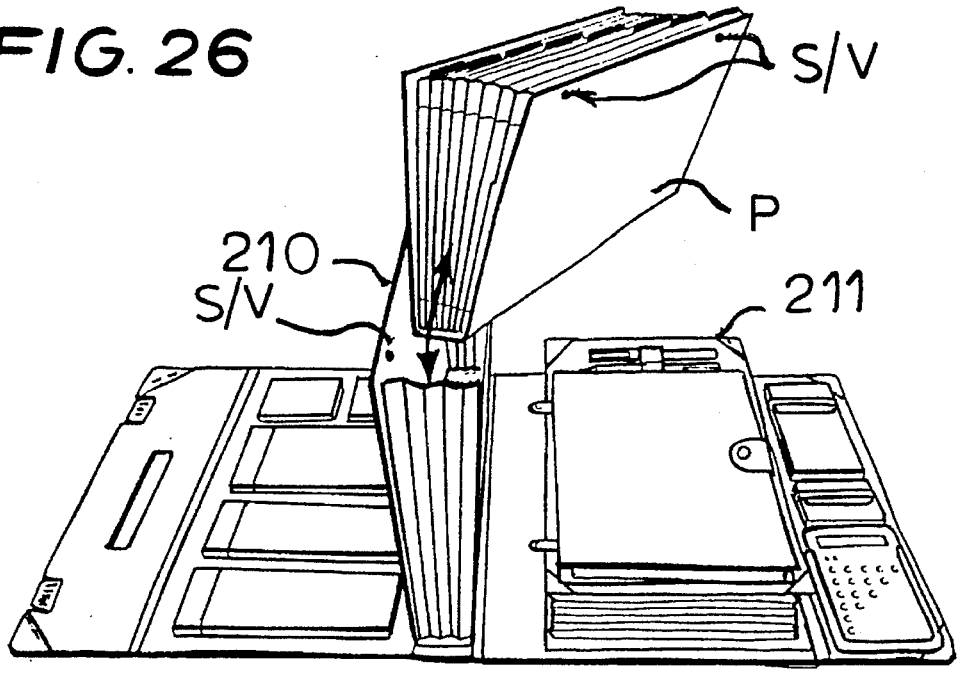

FIG. 8*a* shows two parts of a closure catch;

FIG. 8*b* shows the closure catch being engaged; second type of box file of the present invention;

FIG. 9 is a perspective view from one side of a second type of box file of the present invention;

FIG. 10 is a corresponding view of a similar box file, but arranged for use in an upright configuration;

FIG. 11 is a perspective view of the box file of FIG. 9, with its lid open;

FIG. 12 is a perspective view corresponding to that of FIG. 11, with the internal concertina file extended;

FIG. 13 is a side elevation of the box file in FIG. 12, partially cross-sectioned in a vertical plane;

FIG. 14 is a perspective elevational view of a second type of box file in accordance with the invention;

FIG. 15 is a perspective view of the box file of FIG. 14 with its lid open;

FIG. 16 is a perspective view corresponding to that of FIG. 15 with the internal concertina file extended;

FIG. 17 is a side elevation of the box file of FIG. 14 with the concertina extended;

FIGS 18 and 19 show alternative forms of the box of FIGS 14 to 17;

FIG. 20 shows a first embodiment of a portable filing system and work station in a partially open condition;

FIG. 21 shows the work station of FIG. 20 in the open, operative condition;

FIG. 21*a* is a side elevation of the workstation of FIG. 21;

FIG. 22 is a perspective view of a second type of transportable work station in a closed condition;

FIG. 23 is a plan view of the transportable work station In open condition;

FIG. 24 is a plan view of the transportable work station in an open and operative condition;

FIG. 25 is a perspective view of the open transportable work station;

FIG. 26 is a sketch showing reception of a pocket into a transportable work station;

FIG. 27 is a sketch showing reception of a pocket into a storage box;

FIG. 28 shows a variable size pocket system; and

FIG. 29 shows the storage box in a partially open condition.

Figure 1:
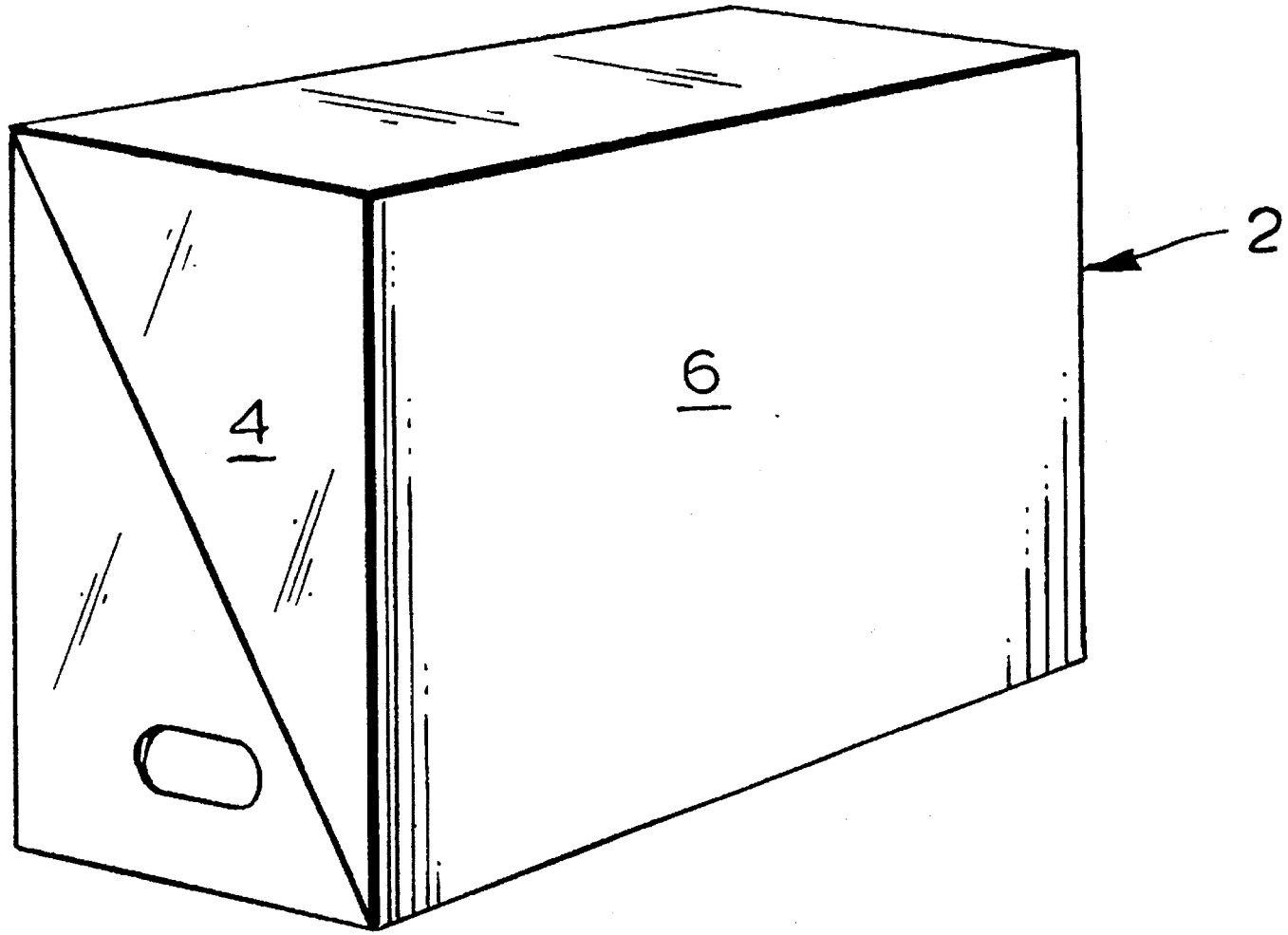
Figure 2:
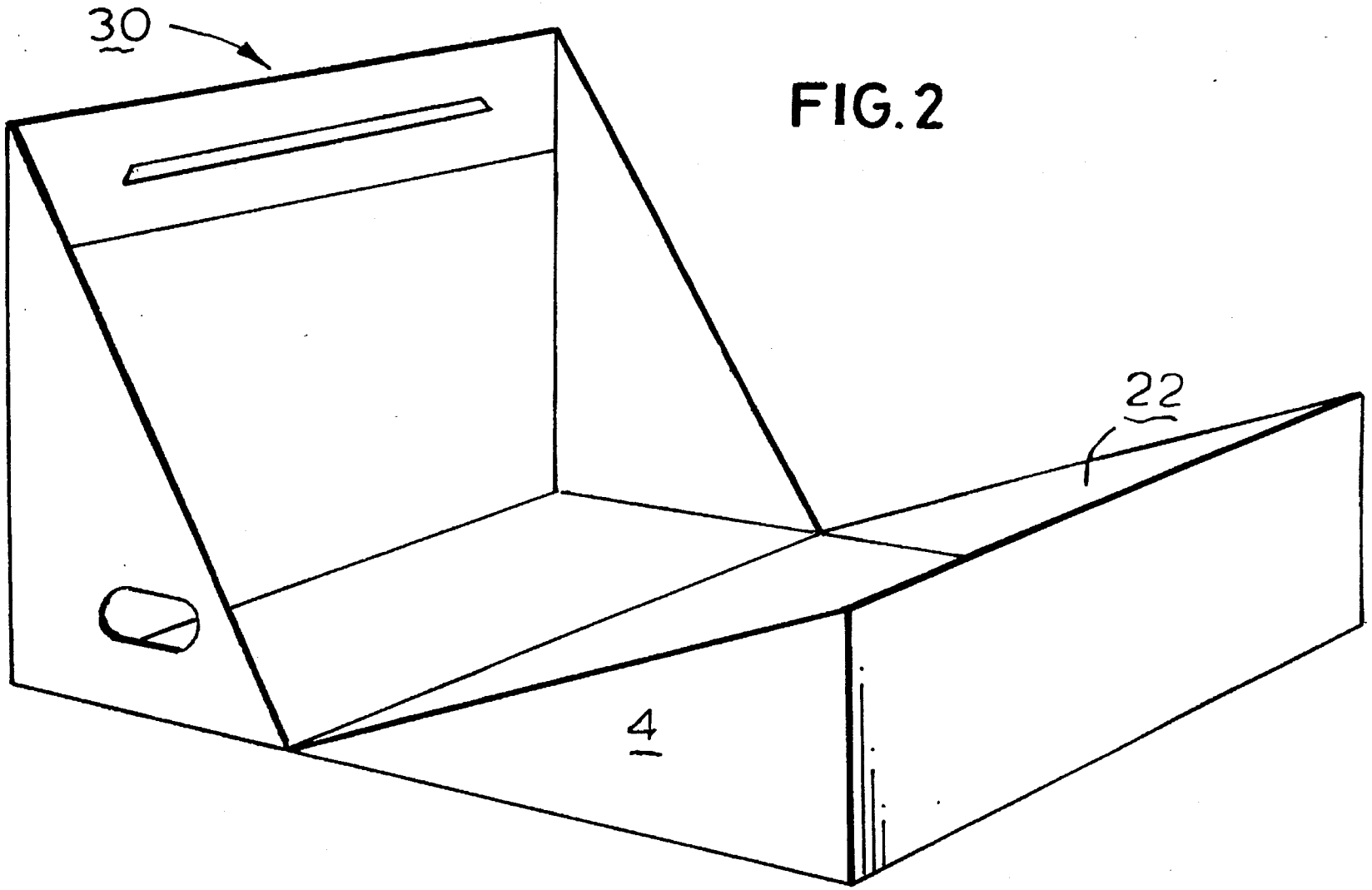
FIG. 2 is a perspective view of the box file of FIG. 1, with its lid open.
Figure 3:
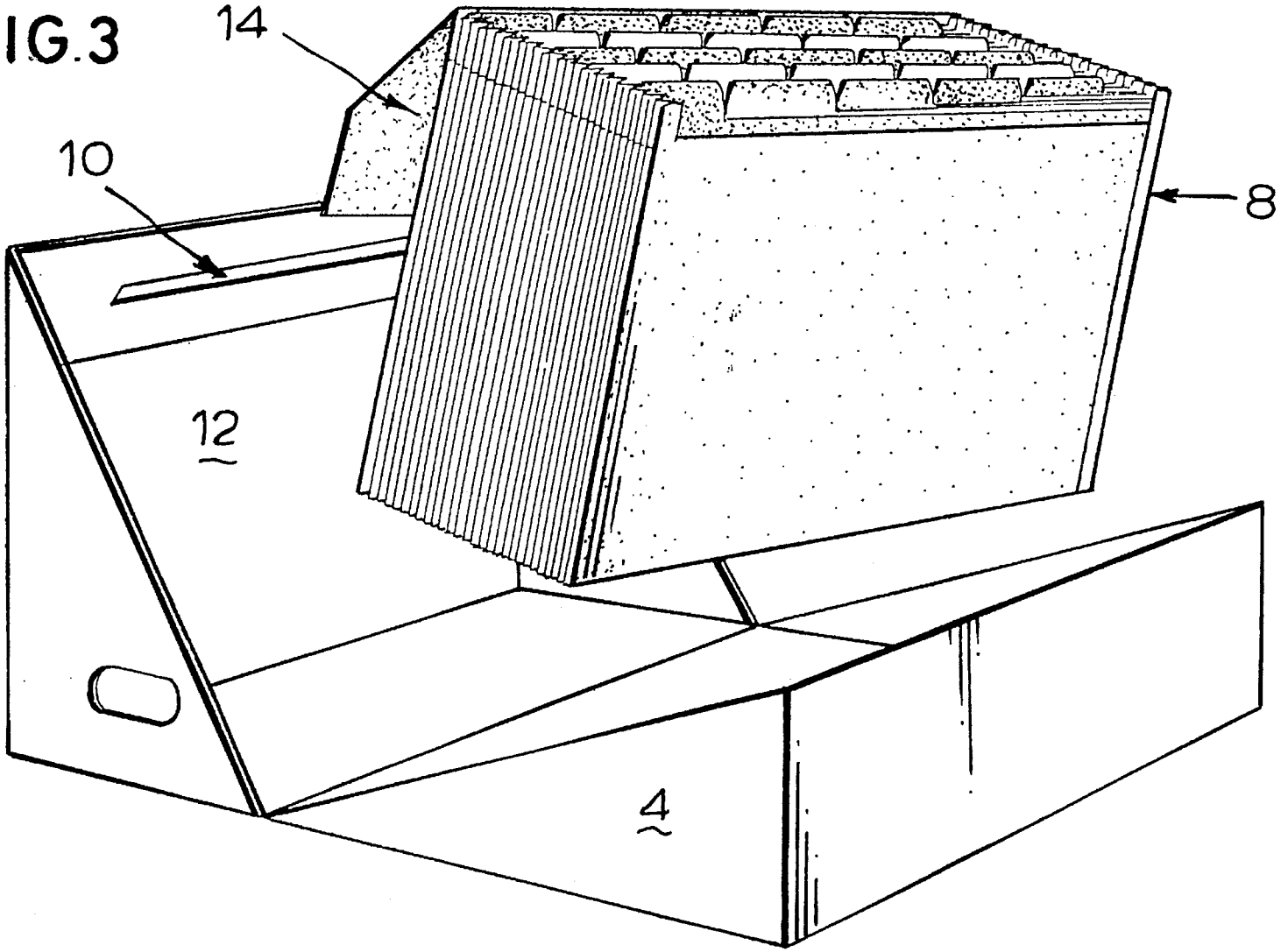
FIG. 3 is a perspective view corresponding to that of FIG. 2, showing a concertina file being inserted.
Figure 4:
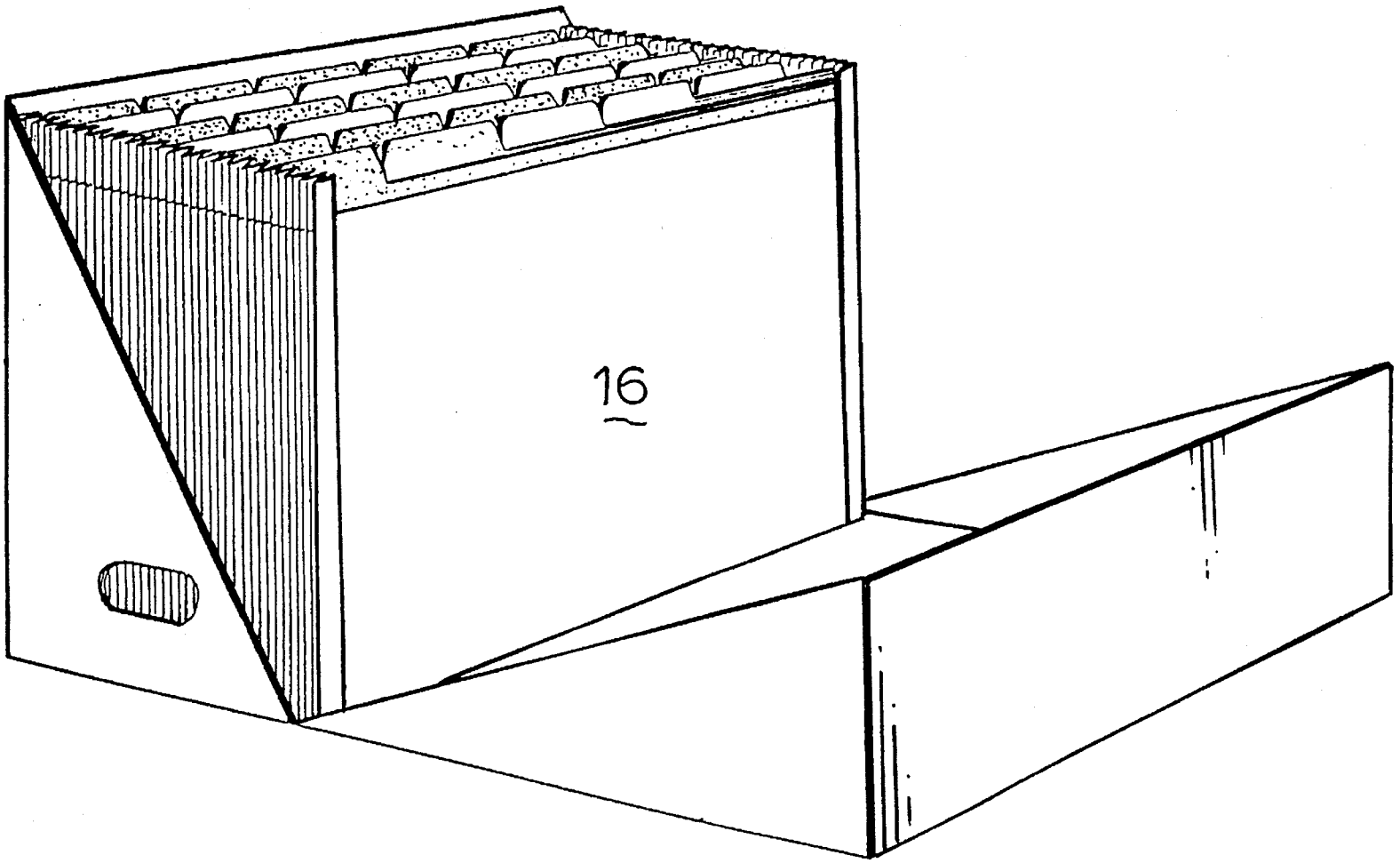
FIG. 4 is a perspective view of the box file of FIG. 3 with the concertina file in position.

Referring to FIG. 1, the box file 2 has diagonally divided end walls 4 and also has one side 6 which forms a lid which can be opened downwardly onto the surface of a table, to the position shown in FIG. 2, and a concertina file 8 is made of a suitable size to be inserted into the box as shown in FIGS. 3 and 4.

Figure 5:
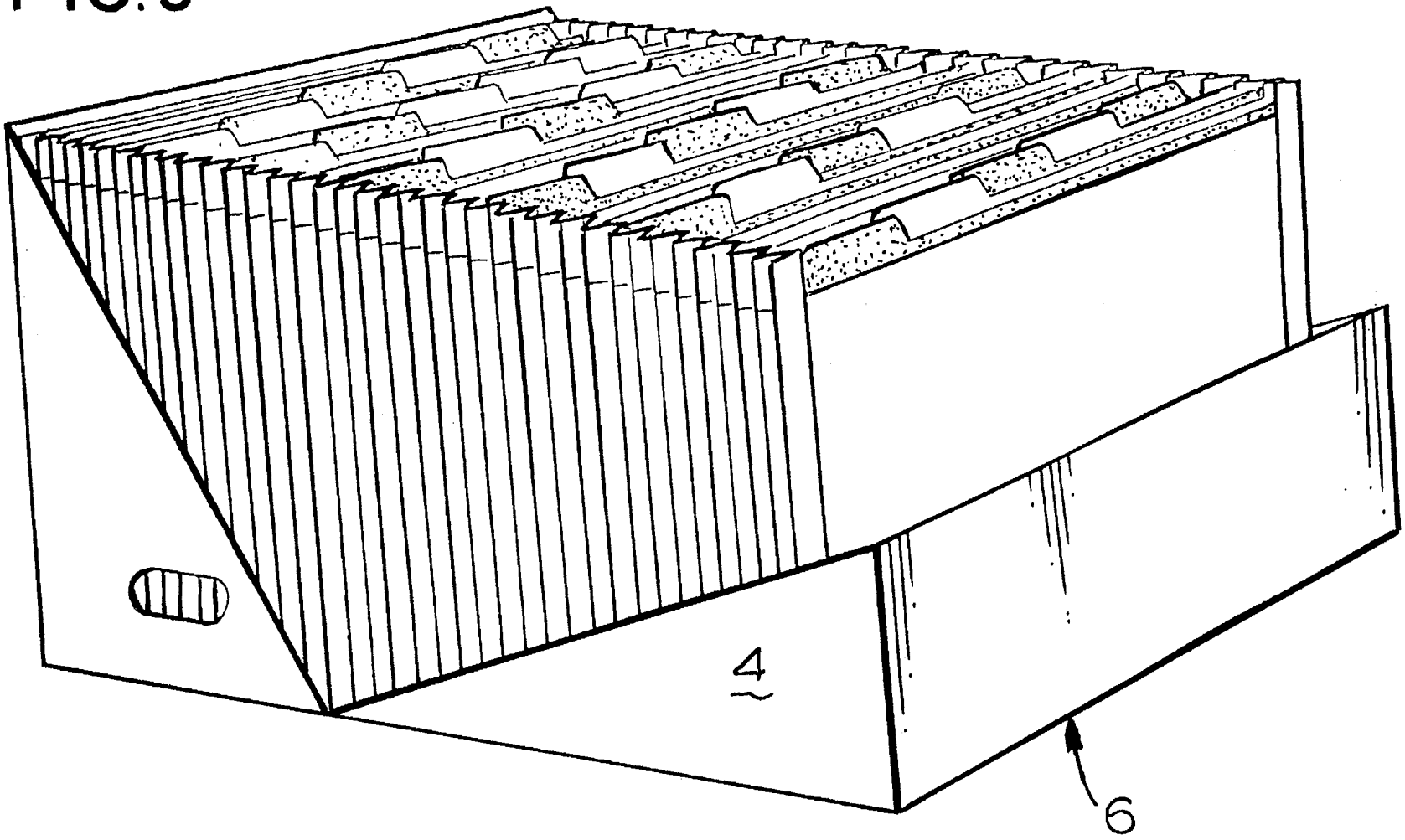
FIG. 5 is a perspective view corresponding to that of FIG. 3 with the internal concertina file extended.
Figure 6:
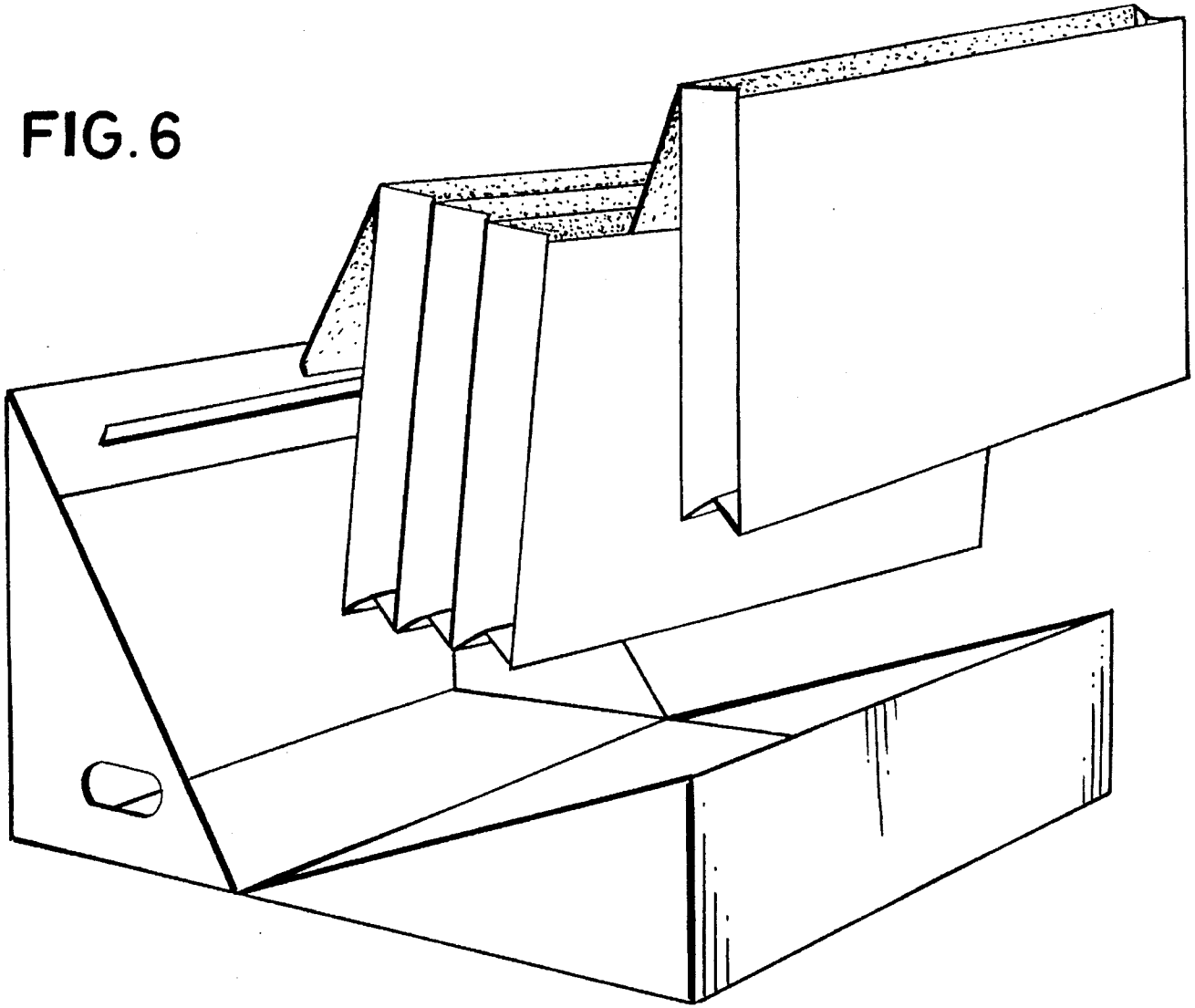
FIG. 6 is a perspective view corresponding to that of FIG. 3 showing the insertion of an alternative arrangement of internal pockets.
Figure 7:
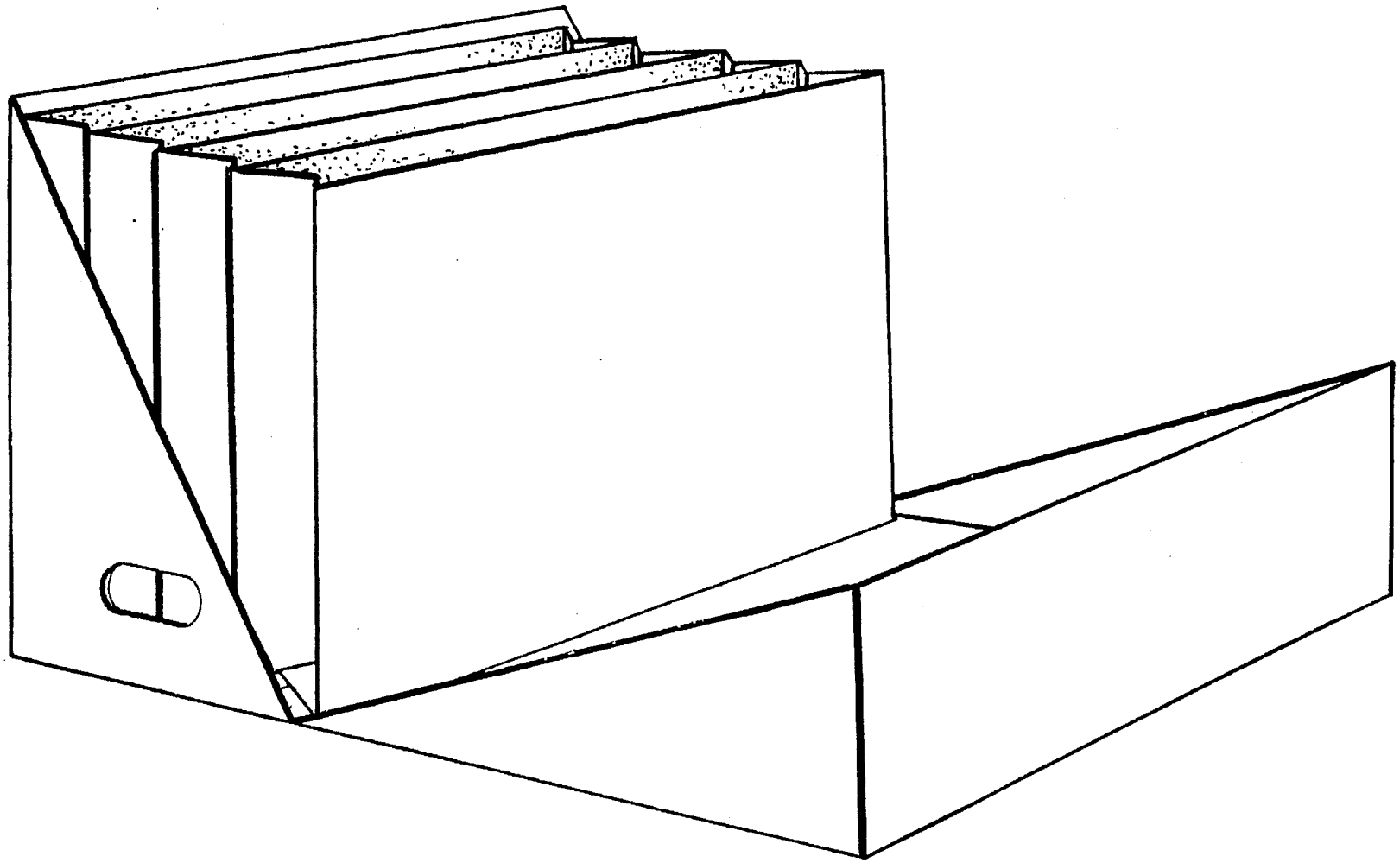
FIG. 7 is a perspective view corresponding to that of FIG. 6 with the pockets in position.

In order to gain access to the contents of the concertina file 8, it is then only necessary to extend the concertina file to the expanded position shown in FIG. 5, in which the lid 6 of the box forms a support for the base of the concertina file.

In order to restrain movement of the concertina file so that it does not simply slide out of the box without expanding, or become completely detached, a slot 10 is provided on the inside surface of the opposite wall 12 of the box file, as shown in FIG. 3, and the corresponding side wall of the concertina file carries a co-operating flap 14 which is inserted in the slot.

In order to enable the contents to be clearly identified, the outer side wall 16 of the concertina file may carry a chart like index sheet, and a corresponding label (not shown) and a corresponding index sheet may be attached to the end of the box. The top edge of each of the concertina file pockets carries a tab in which corresponding index labels can be inserted, and in order to facilitate the production of corresponding labels for the index sheets on the concertina file and the box file, and also for the tabs on the pockets, a self duplicating labelling system may be utilised, in which two additional copies of the label are produced, in addition to the top copy from a three layer laminated construction.

FIG. 8 shows a catch arrangement that is particularly suitable for the box of FIGS. 1 to 7. A channel-section strip of plastics material 20 is fitted to the edge 22 of the top cover of the box (FIG. 2), and a pair of slots or recesses 24 are formed just behind the edge, so that the channel section forms a reinforcement for the edges of the slots. A pair of projecting tongues 26 are formed on one edge of a flat strip 28 which is attached to the co-operating edge 30 of the rear wall of the box, so that the tongues project upwardly, and thus the slots of the cover can be "clipped" over the tongues, simply by utilising the resilience of the box material, as shown in FIG. 8*b*, to close the box.

Referring to FIG. 9, a second type of box file 102 is shown which carries a labelling area 104 on one end, so that it can be stored on a shelf with the label outermost. One side 106 forms a flap-like lid which can be opened downwardly onto the surface of a table, to the position shown in FIG. 11, and a concertina file 108 is made of a suitable size to stand inside the box as shown in FIG. 11.

In order to gain access to the contents of the concertina file 108, it is then only necessary to extend the concertina file to the expanded position shown in FIG. 12, in which the lid 106 of the box forms a support for the base of the concertina file.

In order to restrain movement of the concertina file so that it does not simply slide out of the box without expanding, or become completely detached, a ribbon 110 is connected between the inside surface of the opposite wall 112 of the box file, as shown in FIG. 13, and the corresponding side wall 114 of the concertina file. It will be appreciated from the drawing, that the ribbon is of just sufficient length to allow the concertina file to be withdrawn sufficiently to gain access to all of the pockets.

Again to allow the contents to be clearly identified, the outer side walls 116 of the concertina file may carry a chart like index sheet, and a corresponding index sheet 104 is attached to the end of the box as described above with reference to the first embodiment and a similar labelling scheme may be employed.

Referring to FIG. 14, a preferred form of the second type of box file is shown in which the outer edges of the lid are flanged as shown at 62 and 64 at right angles to the main surface of the lid, and the remainder of the sides and the top are correspondingly "cut-away". The flange portion 64 at the top which is connected to the corresponding edge of the lid, is rather wider than the side flanges 62, so that the lid "wraps around" the remaining portion of the box when it is closed as shown in FIG. 14. When the box is opened as shown in FIG. 15, the lid then forms a tray with the flange portions 62 and 64 guiding and retaining the concertina file as it is moved to the extended position as shown in FIG. 16. This arrangement has a number of advantages over the embodiment of FIGS. 9 to 13:

(a) the concertina file is guided and retained in the open position as mentioned above;

(b) the top of the box is opened more completely to allow free access to the concertina file;

(c) the "wrap-around" top can provide an automatic means of holding the box closed, if the box is made of a suitably resilient, but relatively rigid material.

The box may for example be made from a moulded plastics material which also enables the preferred construction of FIGS. 14 to 17 to be more easily achieved, and improves the strength of the box for stacking purposes. Two possible constructions are shown in FIG. 18 (one-piece polypropylene moulding) and FIG. 19 (two-piece ABS type). This also makes it possible to incorporate ridges across the inside surface of the lid which engage the corrugations on the undersurface of the concertina file when it is extended, so as to hold it in position. Additionally, registration pips or moulded clips (122) may be provided on the edges of the lid, with cooperating formations or apertures (124) on the box, to hold it in the closed position. A handle, or holes for locating a handle, may also be provided in the top to improve the portability of the box.

FIG. 20 shows an embodiment of the invention which provides a portable work station 200 comprising a book-like jacket having a closure flap 202 attached to one cover 208 which can be folded over its open side to secure a concertina-like pocket file 204. The flap carries strips 206 of VELCRO (R.T.M.) or similar material for securing the flap to the other cover 210. In use the cover 210 is folded down as shown in FIG. 21 so that it rests on the surface of a supporting table. The inside surface 212 of the cover carries a writing pad 214 and a calculator 216 for use in accounting or correspondence, and a pen holder 218.

The inside surface of the rear cover 208 may be provided with a closable pocket (not shown) for storing important or confidential papers which it is not desired to leave in the open-topped concertina file.

The concertina file 204 is then opened rearwardly so as to allow easy access to the individual pockets, which are tabbed as illustrated at 220, for easy identification. For this purpose, sets of self-adhesive labels may be provided, or alternately the tabs may be of the kind in which labels are slid into position, for example behind a transparent panel, to allow for easy interchangeability. When the concertina file is extended rearwardly it may be held in position by folding down the closure flap 206 of the rear cover, as shown in FIG. 21, to form a stop as indicated at 224 in FIG. 21. The side of the file facing the user may also carry informational material such as a calendar in a transparent pocket.

As shown in FIG. 21*a*, the concertina file is preferably held in position by means of a flap 230 which extends from one lower edge of the file and is lodged beneath a gusset 232 which extends along the inside of the spine. The flap is preferably folded back on itself, as shown at 234, so as to securely retain the file in position, whilst allowing it to be expanded in the rearward direction as shown in FIG. 21. Alternatively the flap may be inserted in a pocket formed in the inner surface of the front cover 200 as indicated by the dashed lines 222 in FIGS. 20 and 21. In either case the cover can be folded down to the position shown in FIG. 21, whilst the file remains upright. When the file is no longer current or has been completely filled, it can be removed by withdrawing the flap 222 and placed in a storage box in a filing system as explained below with reference to FIG. 27, and the flap 230 can be folded around the end and suitably labelled.

Referring to FIGS. 22 to 25, a second type of portable or transportable work station comprises an outer case 201 made up of side walls 202, 203 interconnected by a central flexible hinge strip 204, and each having a hinged upper closure flap 202*a*, 203*a*, interlockable by means of co-operating latches and hoops 205, 206. A handle 207 on one upper flap 203*a* projects through an aperture 208 in the other upper flap 202*a*. The outer case when opened out can lie with the sides, closure flaps, and central hinge generally flat, see FIG. 25, while when closed as shown in FIG. 22 the work station is rigid in the manner of a brief case.

Pivotally mounted on the inside of each side wall 202, 203, is a rigid box member 210, 211. With the outer one opened out the box members 210, 21 are initially spaced apart (FIG. 21 and 23). The box members can be pushed together so that the hinge 204 folds up between and secured to each other by press studs 212, 213. Similar interlocking means could be used. When so interconnected the upper surfaces of the two box members form a unified work surface.

The transportable work station can also have provision to carry general paraphernalia e.g. calculator, pens, pencil, dictating machine diary "Filofax", (Registered Trade Mark) and pockets for cheque books and the like, as shown in FIG. 21.

As shown in FIG. 28 each of the base members 210, 211, of the transportable work station can receive one or more pockets P. Each pocket P is gusseted to allow expansion to receive paperwork or the like. Each pocket P has studs or VELCRO (S/V) or the like, along each side at the top, for co-operatively engaging with similar pockets or with studs/Velcro (S/V) in the (top) open side of one of the box members 210, 211. Opposite sides of the pocket P have "male" and "female" connections respectively to allow connection to other pockets, and the connecting members on opposite sides of box member are provided with mating connections to allow attachment of one or more pockets.

In the filing system of the preferred embodiment storage boxes SB (FIG. 27) having hinged top flaps to allow pocket P to be received into the box. The box SB has locating means e.g. studs or VELCO (R.T.M.) corresponding to those on the pocket P. The box SB may have a gusseted side to allow inspection of the contents of a pocket P within the box SB, see FIG. 29. The storage boxes SB can of course be arranged systematically on shelves, with a particular box for each pocket. One or more pockets may be stored in a box and interconnected (FIG. 28). If appropriate more pockets and/or more boxes can be utilised as necessary to accommodate an increase in volume of paperwork.

I claim:

1. A box file in two flexibly connected parts, comprising first and second rectangular wall members flexibly connected together along a common side edge, wherein said first and second wall members are coplanar when the box file is opened on a flat surface;

a further wall member rigidly connected to each of said first and second wall members at an edge opposite to said common side edge and each said further wall member extending at right angles to a respective one of said first and second wall members so as to form a box when the two parts are closed together;

retaining means, carried internally of one of said box parts, and adapted to cooperate with an expanding file to be retained in said box;

whereby said expanding file can be extended out onto an inside surface of said second wall member, when said box is opened;

the box also having end walls each of which is divided along a diagonal line from a corner at an end of said common side edge, to an opposite corner, so as to facilitate access to an interior when the box is opened;

and further comprising catch means adapted to hold the box in its closed condition, said catch means comprising a first catch member, mounted at a free edge of one of said first and second wall members and including a projecting tongue, and a second cooperating catch member, which is channel shaped so as to fit onto a free edge of the said further wall member which is connected to the other of said first and second wall members, whereby said channel shaped member forms a detent for said tongue.

2. A box file according to claim 1 wherein said two flexibly connected parts comprise a moulding of resilient plastics material.

3. A box file according to claim 1 in which the connection means comprises a slot or aperture in the wall of the box file, which is adapted to receive a flap connected to the expanding file.

4. A box file according to claim 1 in which the retaining means comprises a cord or a ribbon.

* * * * *